United States Patent [19]

Raasch et al.

[11] Patent Number: 4,769,984

[45] Date of Patent: Sep. 13, 1988

[54] FIBER OPENING, FIBER FEEDING AND YARN WITHDRAWING UNIT FOR A SPINNING STATION OF AN OPEN-END ROTOR SPINNING MACHINE

[75] Inventors: Hans Raasch; Heinz-Georg Wassenhoven, both of Monchen-Gladbach, Fed. Rep. of Germany

[73] Assignee: W. Schlafhorst & Co., Fed. Rep. of Germany

[21] Appl. No.: 112,683

[22] Filed: Oct. 23, 1987

[30] Foreign Application Priority Data

Oct. 24, 1986 [DE] Fed. Rep. of Germany ..... 3636182

[51] Int. Cl.[4] ..... D01H 7/885; D01H 7/892; D01H 1/135

[52] U.S. Cl. ..... 57/407; 57/411; 57/413

[58] Field of Search ..... 57/404, 406–409, 57/411–413

[56] References Cited

U.S. PATENT DOCUMENTS

| | | | |
|---|---|---|---|
| 3,457,716 | 7/1969 | Storek et al. | 57/413 X |
| 3,651,632 | 3/1972 | Shepherd | 57/413 X |
| 3,672,144 | 6/1972 | Didek et al. | 57/413 |
| 4,245,460 | 1/1981 | Staufert et al. | 57/413 |
| 4,471,608 | 9/1984 | Kawabata et al. | 57/411 X |
| 4,516,396 | 5/1985 | Stahlecker et al. | 57/407 |
| 4,660,374 | 4/1987 | Wassenhoven | 57/407 |

FOREIGN PATENT DOCUMENTS

| | | |
|---|---|---|
| 2119571 | 11/1971 | Fed. Rep. of Germany . |
| 2135525 | 1/1972 | Fed. Rep. of Germany . |
| 2419670 | 11/1975 | Fed. Rep. of Germany . |
| 2809008 | 9/1979 | Fed. Rep. of Germany . |

*Primary Examiner*—John Petrakes

*Attorney, Agent, or Firm*—Shefte, Pinckney & Sawyer

[57] ABSTRACT

A fiber opening, fiber feeding and yarn withdrawing unit for a spinning station of an open end rotor spinning machine, in which a projection of the fiber feed conduit extends into the rotor behind the fiber slide wall at a close spacing thereto and to an extent greater than the diametrical extent of the open end of the rotor. The components of the unit are mounted on a unit housing that pivots about an axis transverse to the axis of rotation of the rotor and spaced from the plane of the collection groove of the rotor to the side opposite the rotor open end and also spaced from a plane generally perpendicular to and at the rotor open end of the portion of the fiber slide wall adjacent the fiber feed conduit end, for pivoting of the projection into and out of the rotor without interference therewith. The fiber feed conduit opening in the projection wall is enlarged from the interior of the conduit in the direction of rotation of the rotor and the spacing between the projection and the fiber slide wall of the rotor increases along the enlarged conduit opening.

8 Claims, 1 Drawing Sheet

FIBER OPENING, FIBER FEEDING AND YARN WITHDRAWING UNIT FOR A SPINNING STATION OF AN OPEN-END ROTOR SPINNING MACHINE

BACKGROUND OF THE INVENTION

The present invention relates to an open-end rotor spinning machine, and more particularly to a fiber opening, fiber feeding and yarn withdrawing unit for a spinning station of an open-end rotor spinning machine.

In conventional open-end rotor spinning machines sliver is fed to a fiber opening roller from which the fibers are fed through a conduit into a rotating rotor that has an interior fiber collection groove and a frustoconical fiber slide wall converging from the collection groove to a reduced diameter open end, with the fibers being fed to the fiber slide wall on which they slide into the collection groove and are withdrawn as yarn through a central draw-off tube that is incorporated in the yarn feed conduit element. The fiber feed conduit includes a projection that extends into the rotor, but as it is necessary to periodically clean, maintain and replace the rotor and associated components, the fiber feed conduit must be constructed and mounted so that it can be removed from within the rotor and subsequently reinserted, which is conventionally accomplished by relative axial movement of the fiber feed conduit projection into and out of the rotor open end. For this reason, the fiber feed conduit projection must fit within the open end of the rotor and, therefore, must be of a shape and size such that it does not extend beyond the diametrical extent of the rotor open end. This requirement in combination with the frustoconical shape of the fiber slide wall, results in a considerable spacing between the end of the fiber feeding conduit and the fiber slide wall of the rotor, with the fibers passing through this spacing being free of positive contact with either the feed conduit or the rotor wall, such that the fibers are not subject to control in this spacing and can become disoriented with a resulting deleterious effect on the strength and quality of the yarn being spun.

This spacing is a function of the inclination of the conicity and extent of the slide wall and becomes proportionately greater in relation to the diameter of the rotor when smaller diameter rotors are used with the same extent and conicity of slide wall. As a result, there is a proportionately greater problem of fiber control in passing from the end of the fiber feed conduit through the spacing to the slide wall of the rotor and quality cannot be maintained as well at high draw-off speeds. In this regard, some fibers travel directly into the collection groove rather than slide along the slide wall, and also there is an increase in the likelihood of fibers being picked up on and forming wrapper fibers on the yarn being drawn-off, all reducing the strength and quality of the yarn. Further, the flow of fibers from the end of the fiber feed conduit fans out in the spacing such that the greater spacing in relation to the diameter of the rotor with a corresponding decrease in quality of the yarn produced.

In contrast, the present invention results in the production of high quality yarn at high rotor speeds and high draw-off speeds even with small diameter rotors, while avoiding the aforementioned disadvantages and increasing the spinning effectiveness.

SUMMARY OF THE INVENTION

By the present invention a construction is provided by which the exit end of the fiber feed conduit can be located close to the fiber slide wall on the rotor regardless of the size of the rotor and yet can be inserted and withdrawn without interference with the rotor wall at the reduced diameter open end thereof.

Briefly described, the present invention is a fiber opening, fiber feeding and yarn withdrawing unit for a spinning station of an open-end rotor spinning machine, which station includes a rotor rotatably mounted in a housing and having an interior fiber collection groove in a plane transverse to the axis of rotation of the rotor and an interior frustoconical fiber slide wall converging from the collection groove to a reduced diameter open end that is located in an opening in the housing. The unit of the present invention includes sliver feeding means, fiber opening means, a fiber feed conduit for feeding fibers from the fiber opening means into the rotor, and a cover movable between a closed position covering the housing opening and an open position spaced from the housing opening. The fiber feed conduit has a projection movable with and projecting from the cover into the rotor behind the fiber slide wall when the cover is in the closed position. This projection has a wall portion of approximately the same conicity as the adjacent portion of the fiber slide wall and contains the fiber feeding end of the conduit facing the adjacent fiber slide wall portion. The projection wall portion extends into the rotor to a predetermined spacing from the fiber slide wall and to a greater distance from the rotor axis than the reduced diameter open end of the rotor. The projection has an entrance end of a yarn draw-off tube therein approximately aligned with the rotor axis. The projection is asymmetrical with respect to the rotor axis. The rotor and cover are relatively movable with a component of movement transverse to the rotor axis and a component of movement parallel to the rotor axis for relative movement of the projection into and out of the interior of the rotor upon movement of the cover between closed and open positions.

In the preferred embodiment the predetermined spacing between the projection wall portion and the rotor slide wall at the fiber feeding end of the conduit is a minimum of approximately 1 mm. to 1.5 mm.

Preferably, means are provided for pivotally supporting the cover and projection for pivoting about a pivot axis generally transverse to the rotor axis and spaced from the plane of the collection groove of the rotor to the side thereof opposite the rotor open end for pivoting the cover between open and closed positions and pivoting the projection into and out of the rotor without interference therewith. In the preferred embodiment, the pivot axis is also spaced from a plane generally perpendicular to and at the rotor open end of the portion of the fiber slide wall adjacent the fiber feed conduit end. This location of the pivot axis in relation to the rotor components assures insertion and retraction of the fiber feed conduit projection into the rotor while accommodating a desired minimal spacing of the fiber feed conduit end from the slide wall of the rotor.

Preferably, the unit includes a housing on which the cover, projection, sliver feeding means, fiber opening means and fiber feed conduit are mounted, and the pivotally supporting means pivotally supports the unit housing for pivoting about the pivot axis.

In the preferred embodiment, the opening of the fiber feed conduit in the projection wall is enlarged from the interior of the conduit in the direction of rotation of the rotor and the predetermined spacing of the projection wall from the slide wall increases along the enlarged conduit opening. This facilitates effective fiber delivery from the conduit projection onto the slide wall of the rotor.

Other and further features and advantages of the present invention will be apparent from the accompanying drawings and following detailed description.

DETAILED DESCRIPTION OF THE PREFERRED EMBODIMENT

Figure 1:
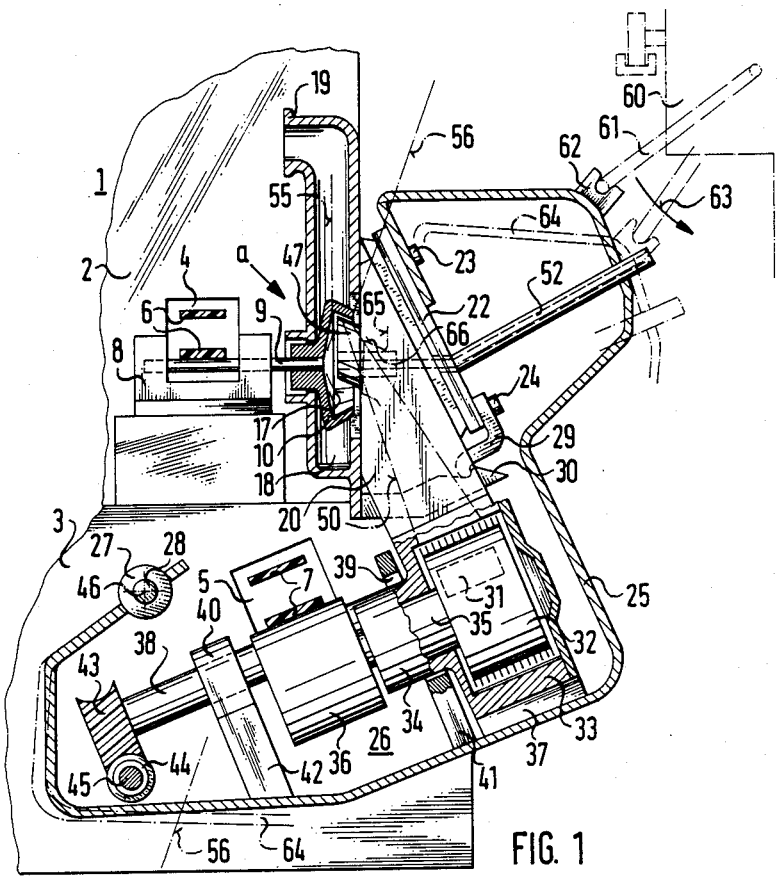
FIG. 1 is a vertical sectional view through a spinning station of an open-end rotor spinning machine in which a fiber opening, fiber feeding and yarn withdrawing unit according to the preferred embodiment of the present invention is incorporated.
Figure 2:
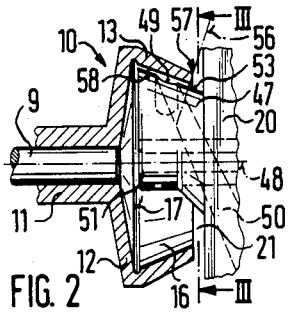
FIG. 2 is an enlargement of the components illustrated in the area designated "a" in FIG. 1.

Referring first to FIG. 1, there is illustrated in cross-section one spinning station 1 of a spinning machine that includes a plurality of such stations. The machine has a frame having crosswalls 2,3 supporting the components thereat and having openings 4,5 for passage of drive belts 6,7, respectively, therethrough. One crosswall 2 supports the mounting 8, not shown in detail, for the drive shaft 9 of a rotor 10.

Figure 3:
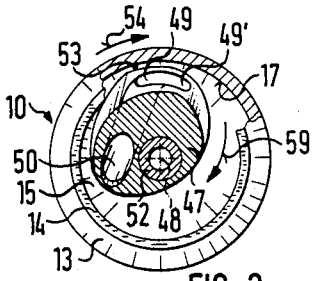
FIG. 3 is a vertical sectional view taken along line III—III of FIG. 2 with a portion of the slide wall of the rotor broken away.

The rotor 10 includes a tubular mounting portion 11 fixed on the shaft 9 for driving rotation thereby, with the rotor 10 having a circular base 12 extending radially outward from the mounting 11 and having an annular wall 13 extending from the periphery of the base 12. The outer wall 13 forms on its interior surface a fiber slide wall 16, which forms a fiber collection groove 17 at the inner end of the fiber slide wall 16 at the intersection with the base 12. The fiber slide wall 16 is frustoconical and converges from the collection groove 17 to a reduced diameter open end 15 defined by the front edge 14 of the wall 13. In FIG. 3, the wall 13 is partially broken away to illustrate the fiber collection groove 17, which is in a plane transverse to the rotor axis 48 and greater in diameter than the open end 15 of the rotor 10 at the outer end of the fiber slide wall 16.

The lower reach of the aforementioned drive belt 6 is in friction driving engagement with the shaft 9 to drivingly rotate the rotor 10. This drive belt 6 extends along the spinning machine in driving engagement with rotor shafts at a plurality of spinning stations.

The rotor 10 is enclosed by a housing 18 mounted on the crosswall 2, in which housing 18 a vacuum is imposed during spinning operation through a conduit 19 connected to a conventional vacuum source, not shown. The housing 18 has an opening 21 at the open end of the rotor 10, which opening 21 is closed by a cover 20 in such a manner that the interior of the rotor 10 communicates with the interior of the housing 18 around the edge of the rotor end 14 through the opening 21 in the housing, with the result that the interior of the rotor 10 is subject to a vacuum during operation of the spinning unit.

The cover 20 is a component of the fiber opening, fiber feeding and yarn withdrawing unit of the present invention and is mounted on a unit housing 25 through a connecting plate 22 and conventional attachments 23,24. This unit housing 25 also has mounted thereon and encloses a fiber opening assembly 26. The unit housing 25 is pivotally supported on the crosswall 3 through a pivot bearing 27 mounted on a pivot pin 28 rotatable on a pivot shaft 46 about an axis generally transverse to the axis of rotation of the rotor 10.

In FIG. 1, the unit housing 25 is illustrated in its operating position with the cover 20 covering the opening 21 in the rotor housing 18. The unit housing 25 is retained in this operating position by engagement of a hook 29 projecting from the aforementioned plate 22 in a recess in a resilient latch member 30 secured to and extending from the rotor housing 18. The resiliency of the latch member 30 allows disengagement of the hook 29 for pivoting of the unit housing 25 into open position away from the opening 21 of the rotor housing 18.

As illustrated in FIG. 1, the aforementioned opening unit 26 includes sliver feed means in the form of a sliver feed roller 31 behind fiber opening means in the form of a fiber opening cylinder 32 mounted in an enclosure 33 shown in section in FIG. 1. The fiber opening cylinder 32 is mounted on a shaft 35 in a bearing 34 of the enclosure 33. This shaft 35 has a whorl 36 mounted on its end in shaft driving engagement by the aforementioned drive belt 7. The enclosure 33 is mounted on the unit housing 25 by a support 37.

The sliver feed roller 31 is mounted on a shaft 38 that in turn is mounted in bearings 39,40 in bearing blocks 41,42 on the unit housing 25. The end of the shaft 38 opposite the sliver feed roller 31 has a worm gear 43 mounted thereon for engagement with a worm 44 mounted on a worm shaft 45 that is driven by conventional means, not shown, to drive the sliver feed roller 31.

With this arrangement, sliver is fed by the sliver feed roller 31 to the opening cylinder 32 that separates the individual fibers from the sliver. The fibers are guided by a fiber feed conduit 50 formed in the aforementioned cover 20 and extending from the sliver opening cylinder 32 to an end 49 in the rotor 10. The end 49 of the fiber feed conduit 50 is formed as a projection 47 of the conduit 50 that is movable with and projects from the cover 20, which projection 47 extends into the rotor 10 asymmetrically with respect to the axis 48 of rotation of the rotor 10. The projection 47 also incorporates the entrance end 51 of a yarn draw-off tube 52 aligned with the rotor axis 51.

The projection 47 has a wall portion 53 of approximately the same conicity as the adjacent portion 58 of the slide wall 16. This projection wall portion 53 contains the fiber feeding end 49 of the fiber feed conduit 50, which faces the adjacent fiber slide wall portion 58. The projection wall portion 53 extends into the rotor behind the fiber slide wall 16 to a predetermined spacing from the fiber slide wall portion 58 and to a greater distance from the rotor axis 48 than the reduced diameter open end 14 of the rotor 10. Preferably, this predetermined spacing includes a minimum spacing of the fiber feeding end 49 of the conduit 50 from the adjacent fiber slide wall portion 58 in the range of approximately 1 mm. to 1.5 mm. In the preferred embodiment, the spacing is approximately 1 mm. This close spacing reduces uncontrolled movement of fibers as they pass from the conduit 50 onto the slide wall 16 and minimizes the formation of wrapper fibers on the yarn by minimizing the number of fibers that contact the yarn being drawn off directly without sliding along the slide surface 16 into the collection groove 17.

However, because of the conicity of the wall 13 of the rotor 10, thi close spacing of the projection 47 from the slide wall 16 could not accommodate insertion and removal of the projection 47 from the rotor interior by conventional axial manipulation of the projection 47 with respect to the rotor 10. By the present invention, the projection 47 can be moved into and out of the rotor 10 by providing that the rotor and cover are relatively movable with a component of movement transverse to the rotor axis 48 and a component of movement parallel to the rotor axis 48 for relative movement of the projection into and out of the interior of the rotor upon movement of the cover between closed and open positions without interference between the projection 47 and the rotor wall 16. This movement is obtained by location of the aforementioned pivot shaft 46 at a spacing from the plane 55 of the collection groove 17 of the rotor 10 to the side thereof opposite the rotor open end 14. As a result, the arc of pivoting of the projection 47 about the axis of the shaft 46 clears the adjacent rotor wall 13 so that there is no interference between the projection 47 and rotor 10 when the cover is pivoted between open and closed positions and the projection 47 is moved into and out of the interior of the rotor 10.

To further assure movement of the projection 47 in and out of the interior of the rotor 10 without interference therewith, the pivot shaft 46 is also spaced from a plane 56 generally perpendicular to and at the rotor open end of the portion 58 of the fiber slide wall 16 adjacent the fiber feed conduit end 49.

To facilitate proper feeding of the fibers, the feed conduit opening 49 in the projection wall portion 53 is enlarged, as indicated at 49' (FIG. 3), from the interior of the conduit 50 in the direction of rotation of the rotor, indicated by the arrow 54 in FIG. 3. In addition, the predetermined spacing between the wall portion 53 of the projection 47 increases along the enlarged conduit opening 49' in the direction 54 of rotation of the rotor 10.

The pivot shaft 46 constitutes means pivotally supporting the unit housing 25 for pivoting about the pivot axis of the shaft 46, and the unit housing 25 has mounted thereon the aforementioned cover 20, projection 47, sliver feeding means 31, fiber opening means 32 and fiber feed conduit 50.

The spinning station 1 is illustrated in the figures with the components in operating position, in which fibers are being transported by air through the fiber feed conduit 50 onto the fiber slide wall 16 of the rotor 10, which is rotating at a high circumferential speed in the direction of arrow 54. Because the end 49 of the fiber feed conduit 50 is enlarged, as indicated at 49', in the direction of rotation 54 of the rotor 10 and the spacing becomes greater, the air flowing from the conduit end 49,49' flows initially predominantly in the direction of the arrow 59 (FIG. 3) through the predetermined and increasing space and then predominantly through the rotor open end 15 and opening 21 in the housing 18 from which it is removed by suction through the conduit 19.

Due to the centrifugal force created by the rotation of the rotor 10, the fibers slide along the fiber slide surface 16 in the direction away from the axis of rotation 48 toward the fiber collection groove 17, from which they are drawn off as yarn through the yarn draw-off tube 52.

When a yarn break occurs or when the sliver runs out, the spinning operation must be restarted, before which the rotor interior should be cleaned. This is accomplished by a traveling service unit 60, shown in dotted lines in FIG. 1. The service unit 60 moves into position at the stopped spinning station 1. The unit 60 has a shifting lever 61 engagable in a bracket 62 on the unit housing 25 for manipulation in a counterclockwise direction, as indicated by the arrow 63. The force of the shifting lever 61 causes the hook 29 to be disengaged from the latch member 30 and causes the unit housing 25 to be pivoted clockwise about the pivot shaft 46 to an open position with the cover 20 spaced from the rotor housing 18 and the projection 47 withdrawn from the interior of the rotor 10. In FIG. 1, the unit housing 25 is partially illustrated in dot-dash lines in an intermediate position, in which the cover is illustrated at 65 and the projection 47 is illustrated at 66. As seen clearly in FIG. 1, the projection 47 moves out of the rotor interior without interference therewith because of its pivoting about the pivot shaft 46 at the aforementioned spacing from the plane 56. The pivot shaft 46 could be located on the plane 56 with pivoting of the projection 47 without interference with the rotor 10 during pivoting of the unit housing 25. Also, the pivot shaft 46 could be located in the space between the aforementioned planes 55 and 56, although the spacing of the projection 47 from the fiber slide wall 16 may, in such case, need to be increased to a spacing of, e.g., 1.5 mm., depending on the length of the fiber slide wall 16 and its conicity. Alternatively, the suspension of the unit housing 25 could be modified or the rotor 10 could be mounted for slight movement away from the projection 47 a few millimeters to permit pivoting of the projection 47 out of the rotor 10 without interference therewith.

When the unit housing 25 is pivoted away from the rotor 10, the worm gear 43 pivots out of meshing engagement with the worm 44 and the drive whorl 36 of the fiber opening cylinder 32 moves out of driven engagement by the drive belt 7.

With the unit so opened, a mechanical or pneumatic cleaning process of a conventional form, not shown, can be performed on the exposed rotor 10. Thereafter, the service unit 60 will pivot the unit housing 25 with the shifting lever 61 back into the closed position with the cover 20 covering the opening 21 in the housing 18 and the projection 47 in operating position within the rotor 10, in which position the spinning station is in condition to resume spinning operation in a conventional manner.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A fiber opening, fiber feeding and yarn withdrawing unit for a spinning station of an open-end rotor spinning machine, said station including a rotor rotatably mounted in a housing and having an interior fiber collection groove in a plane transverse to the axis of rotation of said rotor and an interior frustoconical fiber slide wall converging from said collection groove to a reduced diameter open end, said housing having an opening at the open end of said rotor, said unit comprising sliver feeding means, fiber opening means, a fiber feed conduit for feeding fibers from said fiber opening means into said rotor, a cover movable between a closed position covering said housing opening and an open position spaced from said housing opening, said conduit having a projection movable with and projecting from said cover into said rotor behind said fiber slide wall when said cover is in said closed position, said projection having a wall portion of approximately the same conicity as the adjacent portion of said fiber slide wall and containing the fiber feeding end of said conduit facing said adjacent fiber slide wall portion, said projection wall portion extending into said rotor to a predetermined spacing from said fiber slide wall and to a greater distance from said rotor axis than said reduced diameter open end of said rotor, said projection having an entrance end of a yarn draw-off tube therein approximately aligned with the rotor axis, said projection being asymmetrical with respect to the rotor axis, and said rotor and said cover being relatively movable with a component of movement transverse to the rotor axis and a component of movement parallel to the rotor axis for relative movement of said projection into and out of the interior of said rotor upon movement of said cover between closed and open positions.

2. A fiber opening, fiber feeding and yarn withdrawing unit according to claim 1 and characterized further in that said predetermined spacing includes a minimum spacing of said fiber feeding end of said conduit from said adjacent fiber slide wall in the range of approximately 1 mm. to 1.5 mm.

3. A fiber opening, fiber feeding and yarn withdrawing unit according to claim 1 and characterized further by means pivotally supporting said cover and projection for pivoting about a pivot axis generally transverse to said rotor axis and spaced from said collection groove plane to the side thereof opposite said rotor open end for pivoting said cover between open and closed positions and pivoting said projection into and out of said rotor without interference therewith.

4. A fiber opening, fiber feeding and yarn withdrawing unit according to claim 3 and characterized further by a unit housing on which said cover, projection, sliver feeding means, fiber opening means, and fiber feed conduit are mounted, and said pivotally supporting means pivotally supports said unit housing for pivoting about said pivot axis.

5. A fiber opening, fiber feeding and yarn withdrawing unit according to claim 3 and characterized further in that said pivot axis is spaced form a plane generally perpendicular to and at the rotor open end of said portion of said fiber slide wall adjacent said fiber feed conduit end.

6. A fiber opening, fiber feeding and yarn withdrawing unit according to claim 5 and characterized further by a unit housing on which said cover, projection, sliver feeding means, fiber opening means, and fiber feed conduit are mounted, and said pivotally supporting means pivotally supports said unit housing for pivoting about said pivot axis.

7. A fiber opening, fiber feeding and yarn withdrawing unit according to claims 1, 2, 3, 4, 5 or 6 and characterized further in that said conduit opening in said projection wall is enlarged from the interior of the conduit in the direction of rotation of said rotor.

8. A fiber opening, fiber feeding and yarn withdrawing unit according to claim 7 and characterized further in that said predetermined spacing increases along said enlarged conduit opening.

* * * * *